US012648611B1

(12) United States Patent
Cheney et al.

(10) Patent No.: US 12,648,611 B1
(45) Date of Patent: Jun. 9, 2026

(54) FOOTBED DEVICES AND SYSTEMS FOR FOOTWEAR SIZE ADJUSTMENT

(71) Applicant: FAST IP, LLC, Lindon, UT (US)

(72) Inventors: Craig Cheney, Lindon, UT (US); Kirk Bassett, Lehi, UT (US)

(73) Assignee: FAST IP, LLC, Lindon, UT (US)

( * ) Notice: Subject to any disclaimer, the term of this patent is extended or adjusted under 35 U.S.C. 154(b) by 0 days.

(21) Appl. No.: 18/515,905

(22) Filed: Nov. 21, 2023

Related U.S. Application Data

(60) Provisional application No. 63/426,981, filed on Nov. 21, 2022.

(51) Int. Cl.

| | |
|---|---|
| ***A43B 7/1469*** | (2022.01) |
| ***A43B 7/1425*** | (2022.01) |
| ***A43B 7/1463*** | (2022.01) |
| ***A43B 7/1464*** | (2022.01) |
| ***A43B 7/148*** | (2022.01) |

(52) U.S. Cl.
CPC ..... *A43B 7/1469* (2022.01); *A43B 7/1425* (2013.01); *A43B 7/1463* (2022.01); *A43B 7/1464* (2022.01); *A43B 7/148* (2013.01)

(58) Field of Classification Search
CPC ... A43B 7/1425; A43B 7/1463; A43B 7/1464; A43B 7/1469; A43B 7/148
See application file for complete search history.

(56) References Cited

U.S. PATENT DOCUMENTS

| | | | | |
|---|---|---|---|---|
| 1,208,638 A | | 12/1916 | Phillips | |
| 1,673,126 A | | 6/1928 | Sarra | |
| 1,932,658 A | | 10/1933 | Goodfriend | |
| 2,089,798 A | | 8/1937 | Howell | |
| 2,433,329 A | | 12/1947 | Adler et al. | |
| 2,776,499 A | | 1/1957 | Hilaire | |
| 3,087,262 A | * | 4/1963 | Russell | A43B 13/181 36/28 |
| 3,442,031 A | | 5/1969 | Antell | |
| 4,807,372 A | | 2/1989 | Mccall | |
| 4,813,157 A | | 3/1989 | Boisvert et al. | |
| 4,852,274 A | * | 8/1989 | Wilson | A43B 17/026 36/28 |
| 5,619,809 A | * | 4/1997 | Sessa | A43B 13/185 36/3 R |
| 5,720,118 A | * | 2/1998 | Mayer | A43B 7/1425 36/107 |
| 5,768,803 A | | 6/1998 | Levy | |
| 6,000,147 A | | 12/1999 | Kellerman | |
| 6,092,311 A | * | 7/2000 | MacNamara | A43B 17/18 36/97 |
| 6,205,685 B1 | | 3/2001 | Kellerman | |
| 6,408,543 B1 | | 6/2002 | Erickson et al. | |
| 6,434,859 B1 | * | 8/2002 | Kim | A43B 7/142 36/43 |
| 8,291,616 B2 | | 10/2012 | Digangi | |
| 11,051,577 B1 | | 7/2021 | Cheney et al. | |

(Continued)

OTHER PUBLICATIONS

Ortholite (2019).

*Primary Examiner* — Megan E Lynch

(57) ABSTRACT

The present disclosure comprises a footbed or sole portion having surface features that is configured to be flipped over or switched with that of an opposite shoe to differently engage with an adjacent surface and thereby adjust a shoe between smaller and larger dimension orientations.

9 Claims, 10 Drawing Sheets

(56) References Cited

U.S. PATENT DOCUMENTS 11,576,459 B2 2/2023 Cheney et al.
2001/0052194 A1* 12/2001 Nishiwaki ..... A43B 13/185 36/35 R
2002/0092202 A1* 7/2002 Masseron ..... A43B 13/184 36/28
2005/0268490 A1* 12/2005 Foxen ..... A43B 7/1445 36/28
2006/0059726 A1* 3/2006 Song ..... A61F 5/14 36/144
2006/0107552 A1 5/2006 Clark et al.
2006/0107553 A1* 5/2006 Clark ..... A43B 13/383 36/31
2007/0079532 A1* 4/2007 Ramirez ..... A43B 7/223 36/44
2007/0294922 A1* 12/2007 Ma ..... A43B 7/16 36/142
2008/0127518 A1* 6/2008 Byrne ..... A43B 7/145 36/97
2008/0178493 A1 7/2008 Scofield
2009/0172972 A1 7/2009 Rosen
2010/0212187 A1* 8/2010 Jones ..... A43B 7/142 36/44
2011/0185600 A1 8/2011 Malek
2011/0302805 A1 12/2011 Vito
2012/0180336 A1* 7/2012 Sullivan ..... A43B 13/188 36/31
2012/0210606 A1* 8/2012 Gheorghian ..... A43B 13/127 36/103
2013/0019499 A1* 1/2013 Hsu ..... A43B 17/006 36/44
2013/0104419 A1* 5/2013 Horesh ..... A43B 7/141 36/43
2013/0219744 A1 8/2013 Case et al.
2014/0013619 A1 1/2014 Irving et al.
2014/0123516 A1 5/2014 Cressman et al.
2014/0259752 A1 9/2014 Feldman
2015/0230968 A1* 8/2015 Jaeger ..... A61F 5/14 428/161
2017/0027277 A1* 2/2017 Anthony ..... A43B 7/1463
2017/0112229 A1* 4/2017 Horesh ..... A43B 7/146
2017/0318898 A1 11/2017 Totty et al.
2018/0055143 A1* 3/2018 Baucom ..... A43B 13/183
2018/0070670 A1 3/2018 Granger et al.
2018/0255872 A1 9/2018 Manasiya
2019/0125032 A1 5/2019 Liu
2019/0133252 A1* 5/2019 Jeong ..... A43B 13/181
2021/0212892 A1* 7/2021 Seo ..... A43B 13/127
2024/0114992 A1 4/2024 Pratt et al.
2024/0114996 A1 4/2024 Pratt et al.

* cited by examiner

FOOTBED DEVICES AND SYSTEMS FOR FOOTWEAR SIZE ADJUSTMENT

CROSS-REFERENCE TO RELATED APPLICATION

This application claims priority to and the benefit of U.S. Provisional Patent Application No. 63/426,981, filed Nov. 21, 2022, and entitled "FOOTBED DEVICES AND SYSTEMS FOR FOOTWEAR SIZE ADJUSTMENT," which is incorporated herein by reference in its entirety for all purposes.

FIELD

The present disclosure relates to footbed devices and systems for footwear size adjustment.

BACKGROUND

The present disclosure addresses fit problems in the footwear industry, including the cost of returns related to incorrect fit (in particular in the DTC channel), inventory requirements relating to half sizes and certain wide/narrow sizes, changing morphology of feet for many reasons (e.g., growth, pregnancy, injury, swelling), dynamic footwear needs across different activities (e.g., walking, running, relaxing, recovering), disparate sizes between left and right feet, rapid growth of children's feet before shoes wear out, and other various needs for periodic adjustment of shoe size.

SUMMARY

The present disclosure comprises a device for footwear size adjustment. In example embodiments, such a device comprises a shoe comprising a footbed having a plurality of recesses and a sole portion having a plurality of longer protrusions on a side and a plurality of shorter protrusions on an opposite side. In example embodiments, in a first size orientation, the sole portion is positioned in the shoe such that the plurality of shorter protrusions are adjacent to the footbed and received into the plurality of recesses. In example embodiments, in a second size orientation, the sole portion is rotated and positioned in the shoe such that the plurality of longer protrusions are adjacent to the footbed and received into the plurality of recesses. In example embodiments, the dimension is larger in the second size orientation than in the first size orientation.

A system for adjusting a dimension of a pair of shoes, in accordance with example embodiments of the present disclosure comprises a first shoe of the pair of shoes comprising a first footbed having a first plurality of recesses and a second shoe of the pair of shoes comprising a second footbed having a second plurality of recesses. In example embodiments, the system further comprises a first sole portion having a first plurality of longer protrusions on a side of the first sole portion and a first plurality of shorter protrusions on an opposite side of the first sole portion and a second sole portion having a second plurality of longer protrusions on a side of the second sole portion and a second plurality of shorter protrusions on an opposite side of the second sole portion. In example embodiments, in a first size orientation, the first sole portion is positioned in the first shoe such that the first plurality of shorter protrusions are adjacent to the first footbed and received into the first plurality of recesses, and the second sole portion is positioned in the second shoe such that the second plurality of shorter protrusions are adjacent to the second footbed and received into the second plurality of recesses. In example embodiments, in a second size orientation, the first sole portion is rotated and positioned in the second shoe such that the first plurality of longer protrusions are adjacent to the second footbed and received into the second plurality of recesses, and the second sole portion is rotated and positioned in the first shoe such that the second plurality of longer protrusions are adjacent to the first footbed and received into the first plurality of recesses. In example embodiments, the dimension is larger in the second size orientation than in the first size orientation.

A system for adjusting a dimension of a pair of shoes, in accordance with example embodiments of the present disclosure comprises a first shoe of the pair of shoes comprising a first sole portion having a first plurality of recesses and a second shoe of the pair of shoes comprising a second sole portion having a second plurality of recesses. In example embodiments, the system further comprises a first footbed having a first plurality of protrusions and a second footbed having a second plurality of protrusions. In example embodiments, in a first size orientation, the first footbed is positioned in the first shoe such that the first plurality of protrusions are not adjacent to or received into the first plurality of recesses, and the second footbed is positioned in the second shoe such that the second plurality of protrusions are not adjacent to or received into the second plurality of recesses. In example embodiments, in a second size orientation, the first footbed is rotated and positioned in the second shoe such that the first plurality of protrusions are adjacent to and received into the second plurality of recesses, and the second footbed is rotated and positioned in the first shoe such that the second plurality of protrusions are adjacent to and received into the first plurality of recesses. In example embodiments, the dimension is larger in the second size orientation than in the first size orientation.

BRIEF DESCRIPTION OF THE DRAWINGS

The accompanying drawings may provide a further understanding of example embodiments of the present disclosure and are incorporated in, and constitute a part of, this specification. In the accompanying drawings, only one shoe (either a left shoe or a right shoe) may be illustrated, however, it should be understood that in such instances, the illustrated shoe may be mirror-imaged so as to be the other shoe. The use of like reference numerals throughout the accompanying drawings is for convenience only, and should not be construed as implying that any of the illustrated embodiments are equivalent. The accompanying drawings are for purposes of illustration and not of limitation.

DETAILED DESCRIPTION

Figure 1A:
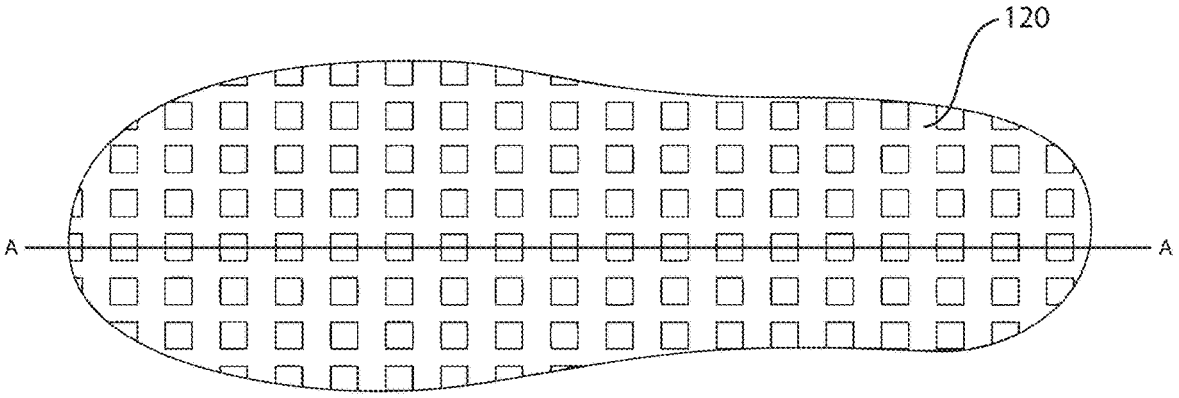
FIGS. 1A and 1B illustrate a footbed and a sole portion, respectively, for an example shoe configured for footwear size adjustment.

Example embodiments of the present disclosure are described in sufficient detail in this detailed description to enable persons having ordinary skill in the relevant art to practice the present disclosure, however, it should be understood that other embodiments may be realized and that mechanical and chemical changes may be made without departing from the spirit or scope of the present disclosure. Thus, this detailed description is for purposes of illustration and not of limitation.

For example, unless the context dictates otherwise, example embodiments described herein may be combined with other embodiments described herein. Similarly, references to "example embodiment," "example embodiments" and the like indicate that the embodiment(s) described may comprise a particular feature, structure, or characteristic, but every embodiment may not necessarily comprise the particular feature, structure, or characteristic. Moreover, such references may not necessarily refer to the same embodiment(s). Any reference to singular includes plural embodiments, and any reference to plural includes singular embodiments.

Any reference to coupled, connected, attached or the like may be temporary or permanent, removeable or not, non-integral or integral, partial or full, and may be facilitated by one or more of adhesives, stitches, hook and loop fasteners, buttons, clips, grommets, zippers and other means known in the art or hereinafter developed.

As used herein, the transitional term "comprising", which is synonymous with "including," "containing," or "characterized by," is inclusive or open-ended and does not exclude additional, unrecited elements or method steps. The transitional phrase "consisting of" excludes any element, step, or ingredient not specified in the claim. The transitional phrase "consisting essentially of" limits the scope of a claim to the specified materials or steps "and those that do not materially affect the basic and novel characteristic(s)" of the claimed invention.

No claim limitation is intended to invoke 35 U.S.C. 112 (f) or pre-AIA 35 U.S.C. 112, sixth paragraph or the like unless it explicitly uses the term "means" and includes functional language.

In describing example embodiments of the present disclosure, certain directional terms may be used. By way of example, terms such as "right," "left," "medial," "lateral," "front," "back," "forward," "backward," "rearward," "top," "bottom," "upper," "lower," "up," "down," and the like may be used to describe example embodiments of the present disclosure. These terms should be given meaning according to the manner in which the present disclosure is most typically designed for use, with the present disclosure underlying a user's foot and with the user's shod foot disposed on or ready for placement on an underlying surface. Thus, these directions may be understood relative to the present disclosure in such use. Similarly, as the present disclosure is intended primarily for use in connection with footwear, terms such as "inner," "inward," "outer," "outward," "innermost," "outermost," "inside," "outside," and the like should be understood in reference to the present disclosure's intended use, such that inner, inward, innermost, inside, and the like signify relatively closer to the user's foot, and outer, outward, outermost, outside, and the like signify relatively farther from the user's foot when the present disclosure is being used for its intended purpose. Notwithstanding the foregoing, if the foregoing definitional guidance is contradicted by an individual use herein of any of the foregoing terms, the term should be understood and read according to the definition that gives life and meaning to the particular instance of the term.

As used herein, unless the context dictates otherwise, a "footwear" refers to an athleisure shoe, a casual shoe, a formal shoe, a dress shoe, a heel, a sports/athletic shoe (e.g., a tennis shoe, a golf shoe, a bowling shoe, a running shoe, a basketball shoe, a soccer shoe, a ballet shoe, etc.), a walking shoe, a sandal, a flip flop, a boot, or other suitable type of shoe. Additionally, footwear can be sized and configured to be worn by men, women, or children.

The present disclosure relates to footbed devices and systems for footwear size adjustment.

Figure 1B:
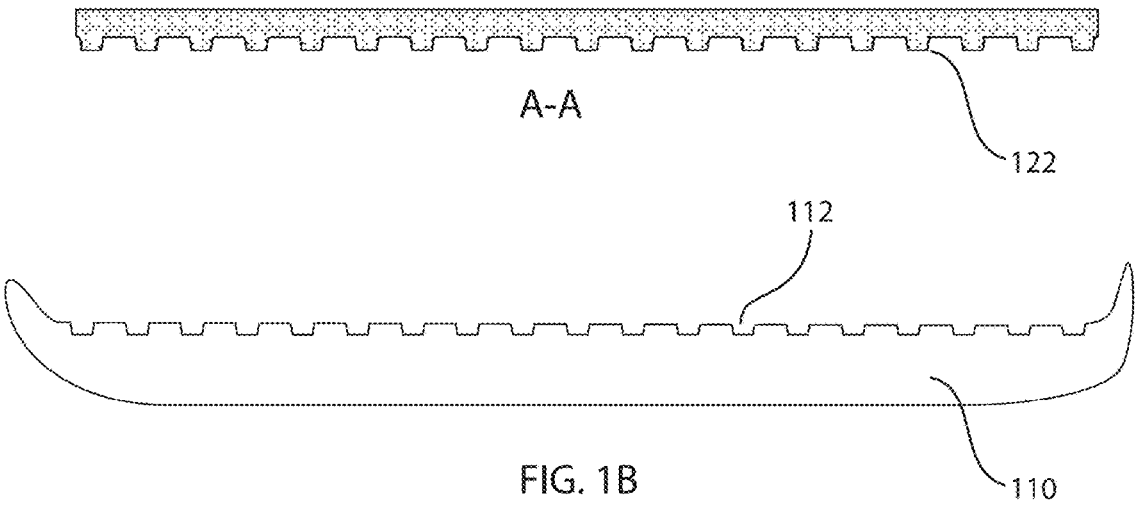

With reference to FIGS. 1A and 1B, a shoe configured for footwear size adjustment, in accordance with example embodiments, comprises a sole portion 110 and a footbed 120.

As used herein, unless the context dictates otherwise, a "sole portion" refers to a strobel or a secondary insert coupled (e.g., sewn into along a flange surrounding a secondary insert) or adjacent to a strobel, and a sole portion can be sized to underlie an entire foot (heel to toe) or exclusively underlie a forefoot.

As used herein, unless the context dictates otherwise, a "footbed" refers to a footbed, insole, sock liner or the like, and a footbed can be sized to underlie an entire foot (heel to toe) or exclusively underlie a forefoot.

In example embodiments, a side of a sole portion 110 comprises one or a plurality of recesses 112. And a side of a footbed 120 (e.g., the footbed being configured to be flipped or rotated as described herein) comprises one or a plurality of protrusions 122 in example embodiments, while the other side of the footbed is either flat or comprises a plurality of different (e.g., longer or shorter) protrusions. In example embodiments, at least one recess 112 of a sole portion 110 corresponds to at least one protrusion 122 of a footbed 120.

In other example embodiments, a side of a footbed comprises one or a plurality of recesses. And a side of a sole portion (e.g., the sole portion being configured to be flipped or rotated as described herein) comprises one or a plurality of protrusions in example embodiments, while the other side of the sole portion is either flat or comprises a plurality of different (e.g., longer or shorter) protrusions. In example embodiments, at least one recess of a footbed corresponds to at least one protrusion of a sole portion.

As used herein, unless the context dictates otherwise, a "recess" is generally a negative surface feature and may be defined by adjacent protrusions on either side, and a "protrusion" is generally a positive surface feature and may be defined by adjacent recesses on either side. In this regard, a plurality of recesses as described herein shall be considered synonymous with a plurality of protrusions.

Figure 2A:
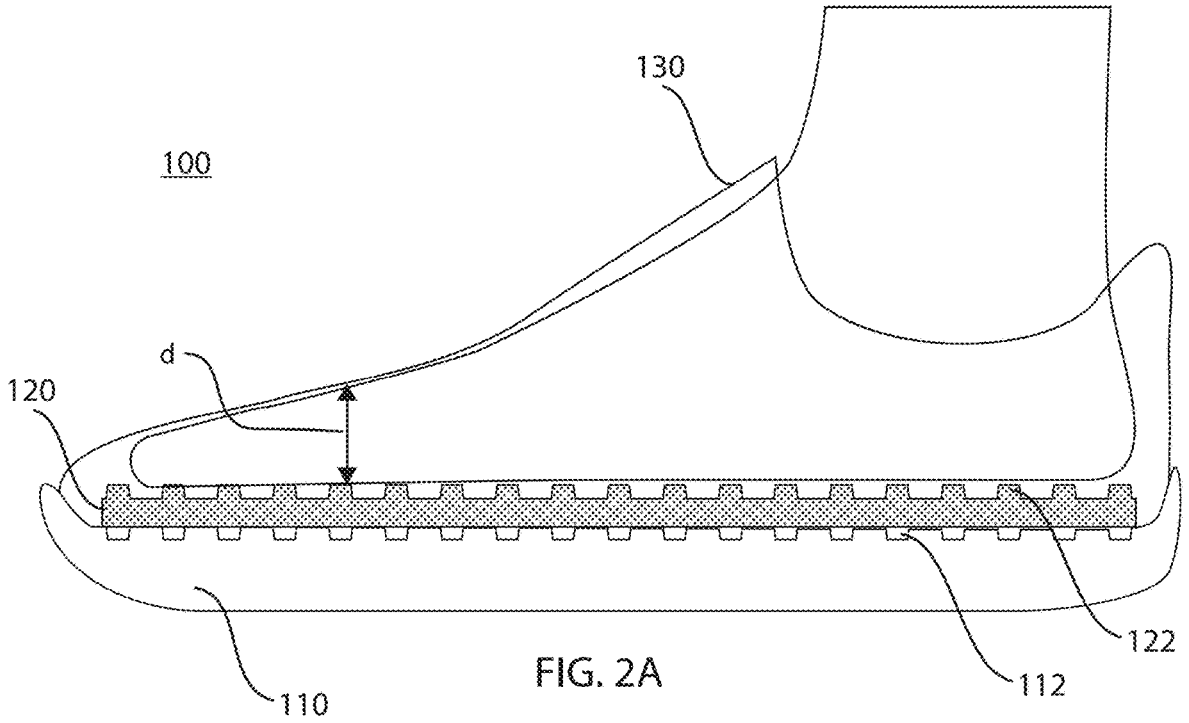
FIGS. 2A and 2B illustrate a first smaller size orientation and a second larger size orientation, respectively, for an example shoe configured for footwear size adjustment.
Figure 2B:
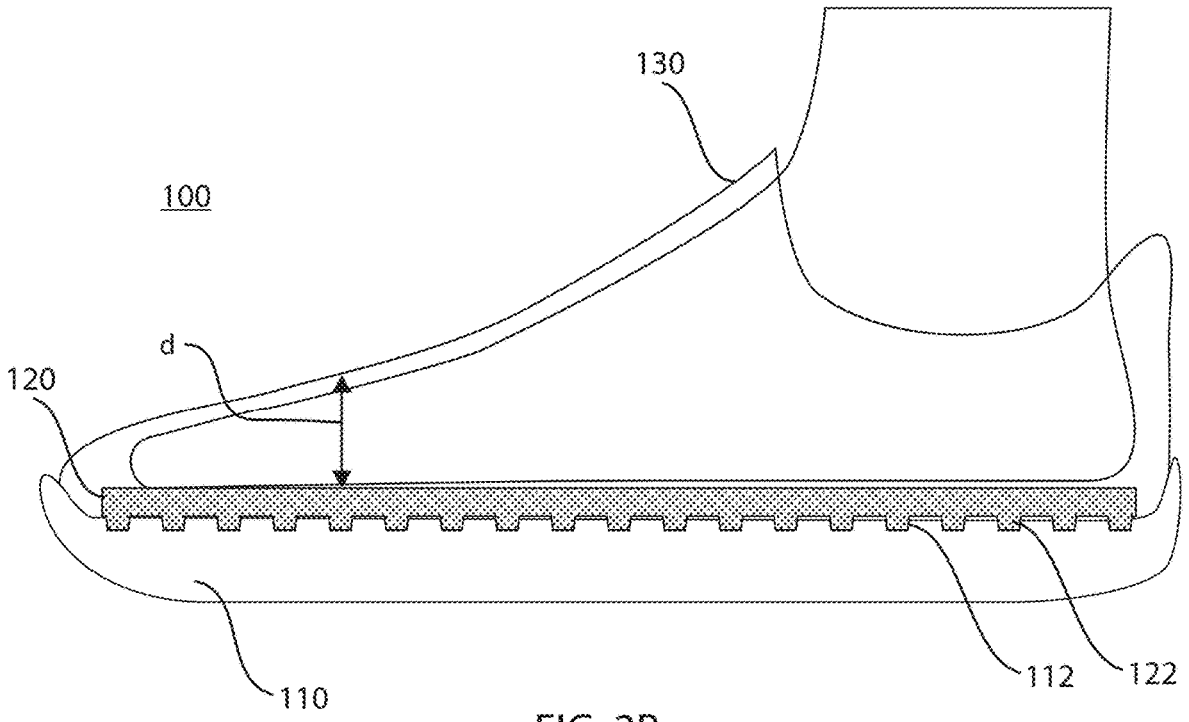

With reference now to FIGS. 2A and 2B, in accordance with example embodiments, a shoe 100 configured for footwear size adjustment has a first size orientation (FIG. 2A) and a second size orientation (FIG. 2B). In accordance with example embodiments, a dimension d is larger in the second size orientation than in the first size orientation.

In example embodiments, the dimension d is inner girth, width, length and/or inner volume, e.g., defined by an upper 130 of the shoe 100. In example embodiments, the dimension d corresponds to the length of a protrusion of the first plurality of protrusions and/or the depth of a recess of the first plurality of recesses.

In the second size orientation (e.g., FIG. 2B), protrusions 122 of a footbed 120 are nested or otherwise received within recesses 112 of a sole portion 110, while in the first size orientation (e.g., FIG. 2A), no protrusions 122 of the footbed 120 or different (e.g., longer or shorter) protrusions of the footbed 120 are nested or otherwise received within recesses 112 of the sole portion 110. For example, a footbed can be rotated or flipped over 180 degrees. Alternatively, a first footbed can be switched with a second footbed (e.g., multiple footbeds included in a kit, or right and left footbeds of a pair of shoes).

In this regard, a system for adjusting a dimension of a pair of shoes, in accordance with example embodiments, comprises a first shoe (e.g., a right shoe) comprising a first sole portion having a first plurality of recesses and a second shoe (e.g., a left shoe) comprising a second sole portion having a second plurality of recesses. A system for adjusting a dimension of a pair of shoes, in accordance with example embodiments, further comprises a first footbed having a first plurality of protrusions and a second footbed having a second plurality of protrusions.

Similar to above, in accordance with example embodiments, a system for adjusting a dimension of a pair of shoes has a first size orientation and a second size orientation. In accordance with example embodiments, the dimension is larger in the second size orientation than in the first size orientation.

In a first size orientation of an example embodiment, the first footbed is positioned in the first shoe such that the first plurality of protrusions are not adjacent to (i.e., so not received into) into the first plurality of recesses, and the second footbed is positioned in the second shoe such that the second plurality of protrusions are not adjacent to (i.e., so not received into) into the second plurality of recesses.

In a second size orientation of an example embodiment, the first footbed is rotated or flipped over 180 degrees and positioned in the second shoe (i.e., switched from the first to the second shoe) such that the first plurality of protrusions are adjacent to and received into the second plurality of recesses, and the second footbed is rotated or flipped over 180 degrees and positioned in the first shoe (i.e., switched from the second to the first shoe) such that the second plurality of protrusions are adjacent to and received into the first plurality of recesses.

While example embodiments have been described wherein a footbed is rotated or flipped over 180 degrees, other example embodiments contemplate a sole portion being rotated or flipped over 180 degrees. More specifically, and as mentioned above, in example embodiments a sole portion comprises a secondary insert adjacent to a strobel. In such embodiments, the sole portion can be rotated or flipped over 180 degrees between a first size orientation and a second size orientation.

Figures 3A, 3B:
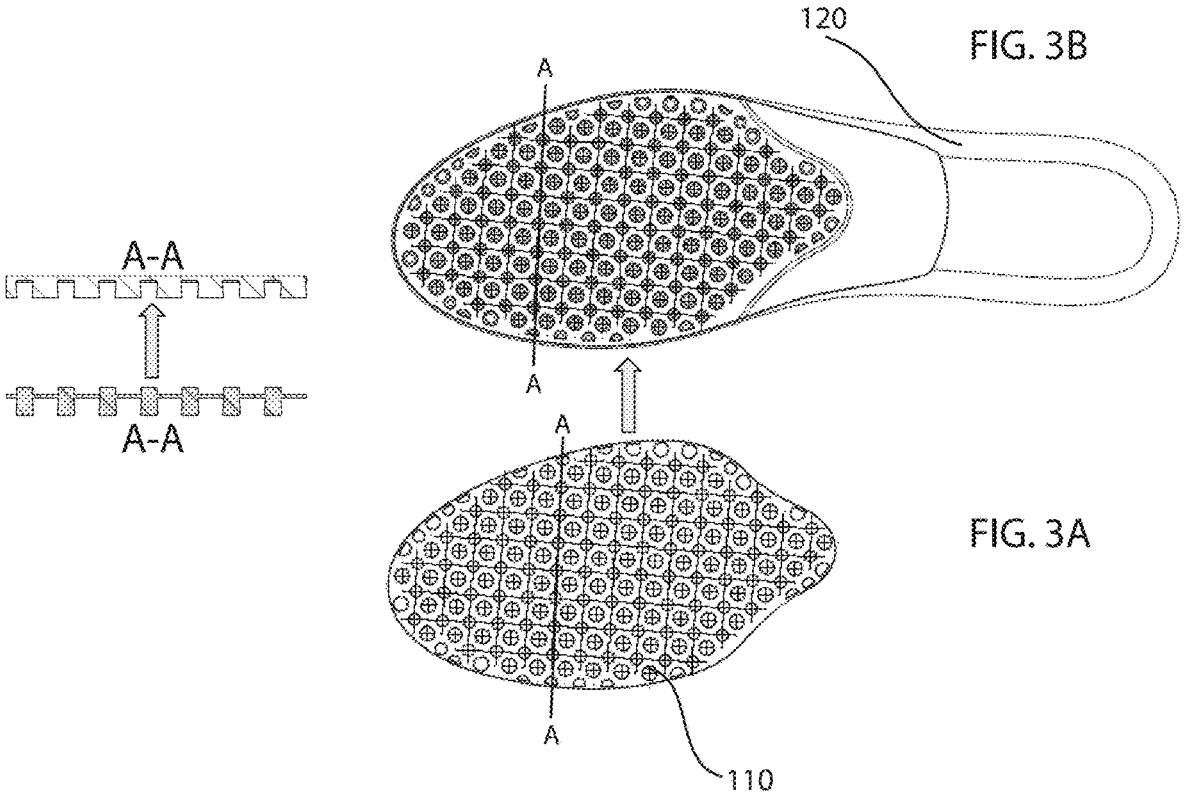
FIGS. 3A-3C illustrate a sole portion configured to be rotated or flipped between first and second size orientations.
Figure 3C:
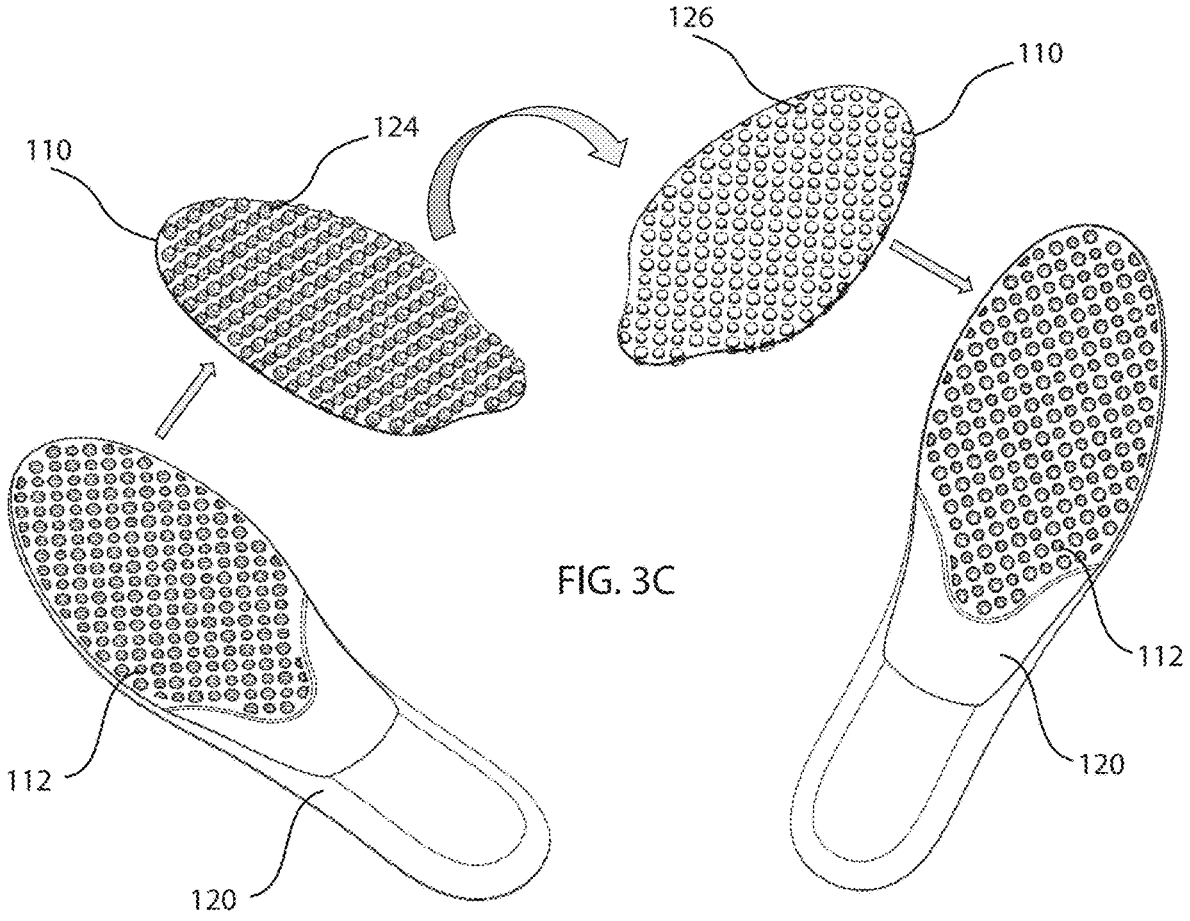

For example, and with reference to FIGS. 3A-3C, a plurality of protrusions are located on a sole portion 110 (in this embodiment, a secondary insert adjacent to a strobel), the sole portion 110 being sized to exclusively underlie a forefoot. In this embodiment, the sole portion 110 comprises a plurality of shorter protrusions 126 on a side and a plurality of longer protrusions 124 on an opposite side. In example embodiments, a plurality of recesses are located exclusively on a forefoot portion of a footbed 120 (or the footbed is sized to exclusively underlie a forefoot).

With specific reference to FIG. 3C, in accordance with example embodiments, a shoe configured for footwear size adjustment is adjusted from a first size orientation (at left) to a second size orientation (at right). In the second size orientation, longer protrusions 124 of a sole portion 110 are nested or otherwise received within recesses 112 of a footbed 120, while in the first size orientation, shorter protrusions 126 of the sole portion 110 are nested or otherwise received within recesses 112 of the footbed 120. For example, a sole portion can be rotated or flipped over 180 degrees. Alternatively, a first sole portion can be switched with a second sole portion (e.g., multiple sole portions included in a kit, or right and left sole portions of a pair of shoes).

In this regard, a system for adjusting a dimension of a pair of shoes, in accordance with example embodiments, comprises a first shoe (e.g., a right shoe) comprising a first footbed having a first plurality of recesses and a second shoe (e.g., a left shoe) comprising a second footbed having a second plurality of recesses. A system for adjusting a dimension of a pair of shoes, in accordance with example embodiments, further comprises a first sole portion having a longer plurality of protrusions on a side and a shorter plurality of protrusions on an opposite side and a second sole portion having a longer plurality of protrusions on a side and a shorter plurality of protrusions on an opposite side. In example embodiments, the recesses have a depth greater than or approximately equal to the height of the longer protrusions.

Similar to above, in accordance with example embodiments, a system for adjusting a dimension of a pair of shoes has a first size orientation and a second size orientation. In accordance with example embodiments, the dimension is larger in the second size orientation than in the first size orientation.

In a first size orientation of an example embodiment, the first sole portion is positioned in the first shoe adjacent to the first footbed such that the first sole portion shorter protrusions are adjacent to and received into the first plurality of recesses, and the second sole portion is positioned in the second shoe adjacent to the second footbed such that the second sole portion shorter protrusions are adjacent to and received into the second plurality of recesses.

In a second size orientation of an example embodiment, the first sole portion is rotated or flipped over 180 degrees and positioned in the second shoe adjacent to the second footbed (i.e., switched from the first to the second shoe) such that the first sole portion longer protrusions are adjacent to and received into the second plurality of recesses, and the second sole portion is rotated or flipped over 180 degrees and positioned in the first shoe adjacent to the first footbed (i.e., switched from the second to the first shoe) such that the second sole portion longer protrusions are adjacent to and received into the first plurality of recesses.

In example embodiments, the thickness of a sole portion or a footbed can be variable. For example, a sole portion or a footbed can comprise a transition zone sized to exclusively underlie an arch, the transition zone having a thickness (e.g., contoured, tapered or stepped at an edge of the transition zone) different from that of the adjacent and/or surrounding sole portion or footbed. In example embodiments, an edge of a transition zone is defined by a straight line, while in other example embodiments, an edge of a transition zone is defined by a curve (e.g., following the anatomy of the metatarsals). In this regard, a transition zone of a sole portion or a footbed can facilitate increased arch support.

With specific reference to FIGS. 4A-4E, a sole portion 110 can comprise a transition zone 145 sized to exclusively underlie an arch, the transition zone 145 having a thickness (e.g., contoured, tapered or stepped at an edge 140 of the transition zone 145) different from that of the adjacent and/or surrounding sole portion 110. For example, the transition zone 145 can have a thickness smaller than that of the adjacent and/or surrounding sole portion 110. In example embodiments, the edge 140 of the transition zone 145 is defined by a curve extending between a medial side of an arch and a lateral side of an arch. In this regard, a transition zone of a sole portion can facilitate increased arch support.

Figure 4A:
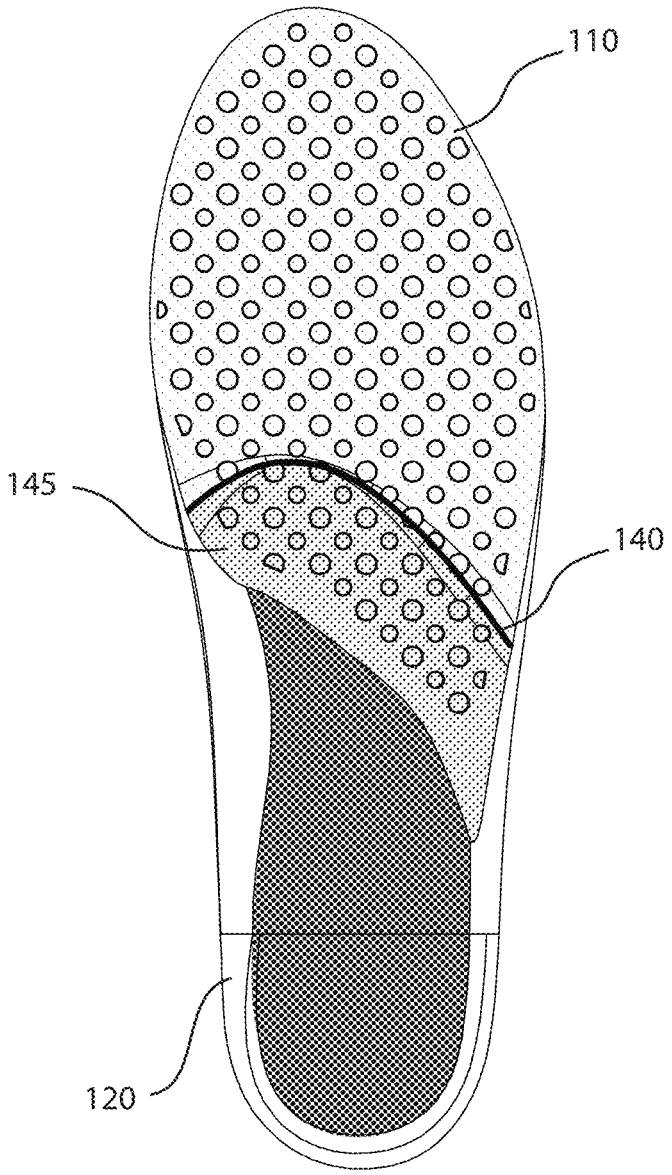
FIGS. 4A-4E illustrate a sole portion having a transition zone configured to be rotated or flipped between first and second size orientations and also facilitate arch support adjustment.
Figure 4B:
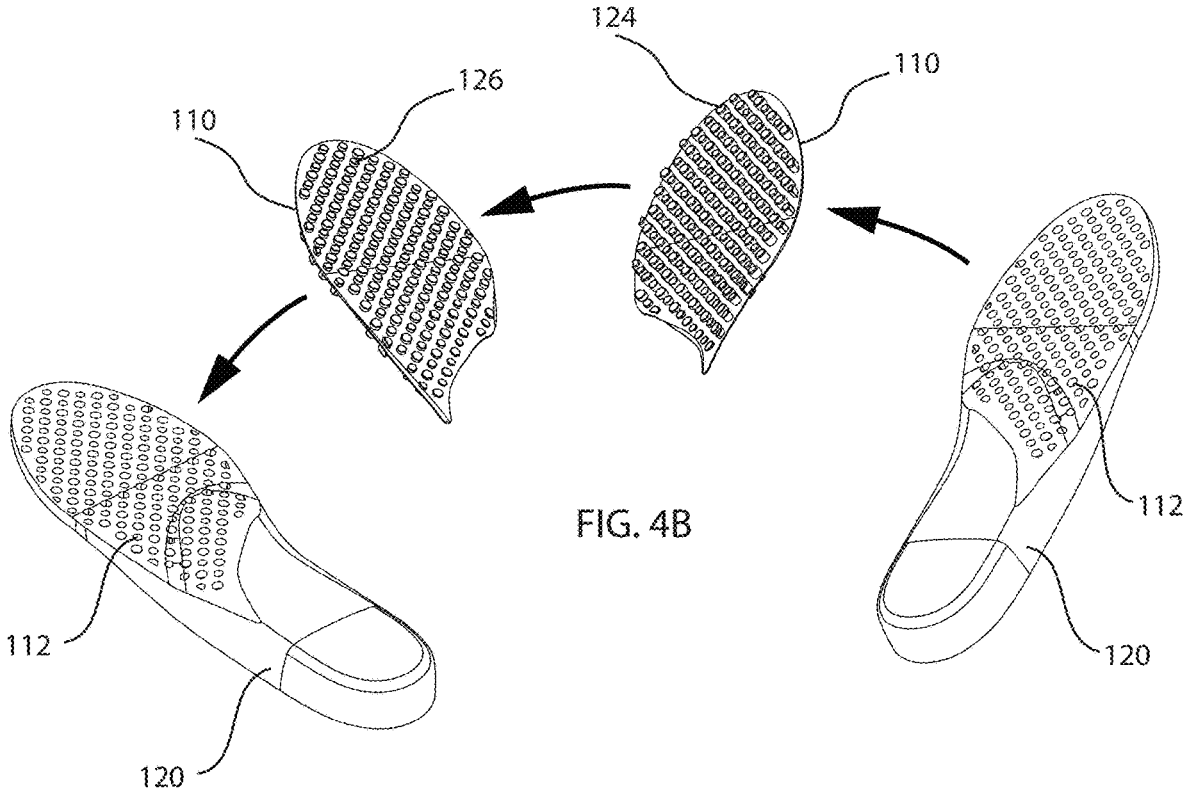

With specific reference to FIG. 4B, in accordance with example embodiments, a shoe configured for footwear size adjustment is adjusted from a first size orientation (at right) to a second size orientation (at left). In the second size orientation, longer protrusions 124 of a sole portion 110 (in this embodiment, a secondary insert adjacent to a strobel) are nested or otherwise received within recesses 112 of a footbed 120, while in the first size orientation, shorter protrusions 126 of the sole portion 110 are nested or otherwise received within recesses 112 of the footbed 120. For example, a sole portion can be rotated or flipped over 180 degrees. Alternatively, a first sole portion can be switched with a second sole portion (e.g., multiple sole portions included in a kit, or right and left sole portions of a pair of shoes).

Figure 4C:
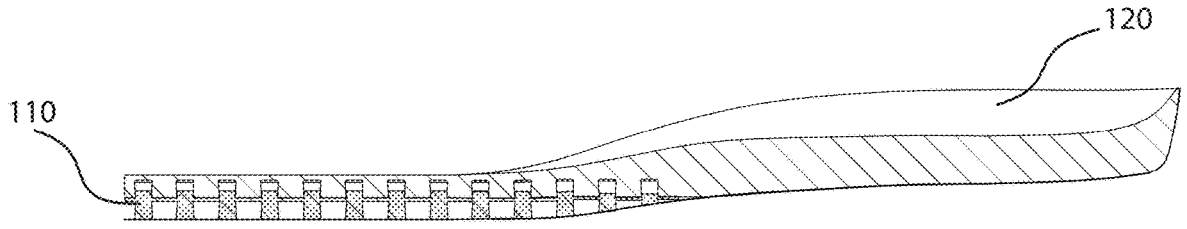
Figure 4D:
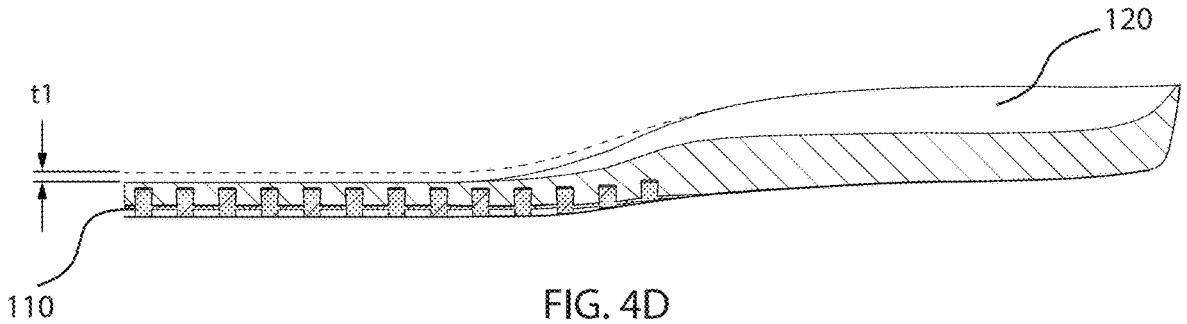
Figure 4E:
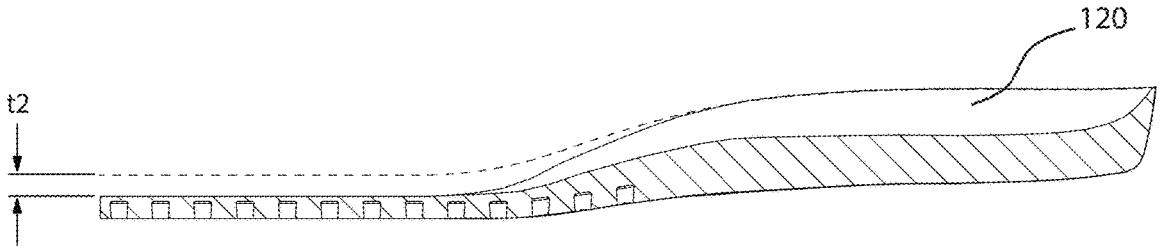

Additionally, and with specific reference to FIGS. 4C-4E, an arch zone defined by a strobel can be more filled (the arch zone thus being less pronounced and perceptible to a user) by a sole portion 110 transition zone (e.g., as in FIG. 4C), less filled (the arch zone thus being more pronounced and perceptible to a user by a thickness t1) by a sole portion 110 transition zone (e.g., as in FIG. 4D) or not filled (the arch zone thus being most pronounced and perceptible to a user by a thickness t2) by a sole portion transition zone (e.g., as in FIG. 4E). In example embodiments, t1 can be at least 1 mm, or from about 2 to about 4 mm, or about 3 mm. In example embodiments, t2 can be at least 2 mm, or from about 4 to about 8 mm, or about 6 mm.

In example embodiments, a plurality of protrusions and a plurality of recesses are a uniform shape (e.g., one or more elliptical or non-elliptical shapes).

As used herein, unless the context dictates otherwise, an "elliptical" shape refers to any shape that generally lacks a point where two lines, curves, or surfaces converge to form an angle. For example, an "elliptical" shape encompasses traditional Euclidian geometric shapes such as circles and ellipses, as well as other non-angular shapes (that lack any angles), even if those shapes do not have designations common in Euclidian geometry.

As used herein, unless the context dictates otherwise, a "non-elliptical" shape refers to any shape that includes at least one point where two lines, curves, or surfaces converge to form an angle. For example, a "non-elliptical" shape encompasses traditional Euclidian geometric shapes such as triangles, rectangles, squares, hexagons, trapezoids, pentagons, stars, and the like, as well as other shapes that have at least one angle, even if those shapes do not have designations common in Euclidian geometry.

In example embodiments, a plurality of protrusions and a plurality of recesses permit imperfect alignment. Stated another way, in example embodiments, a single protrusion may correspond to more than a single recess.

In example embodiments, a plurality of protrusions and a plurality of recesses are not uniform.

Figure 5A:
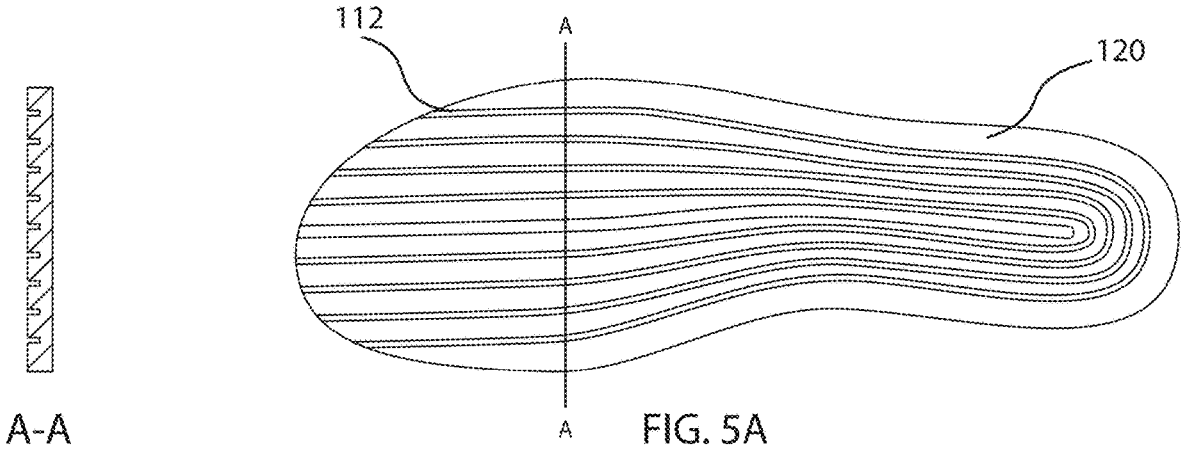
FIGS. 5A-5E illustrate a footbed and a sole portion for an example shoe configured for footwear size adjustment, each having a series of corresponding concentric curves.
Figure 5B:
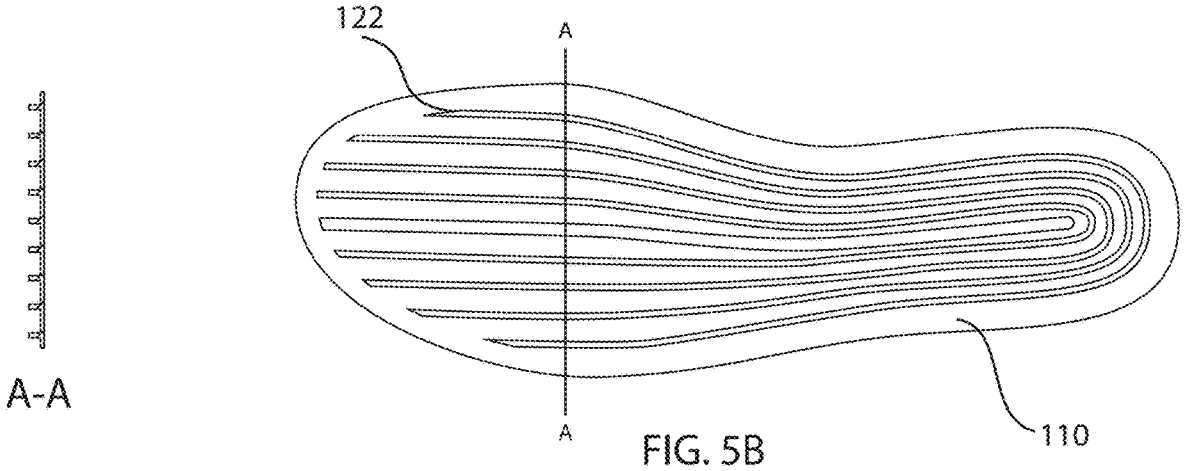
Figure 5C:
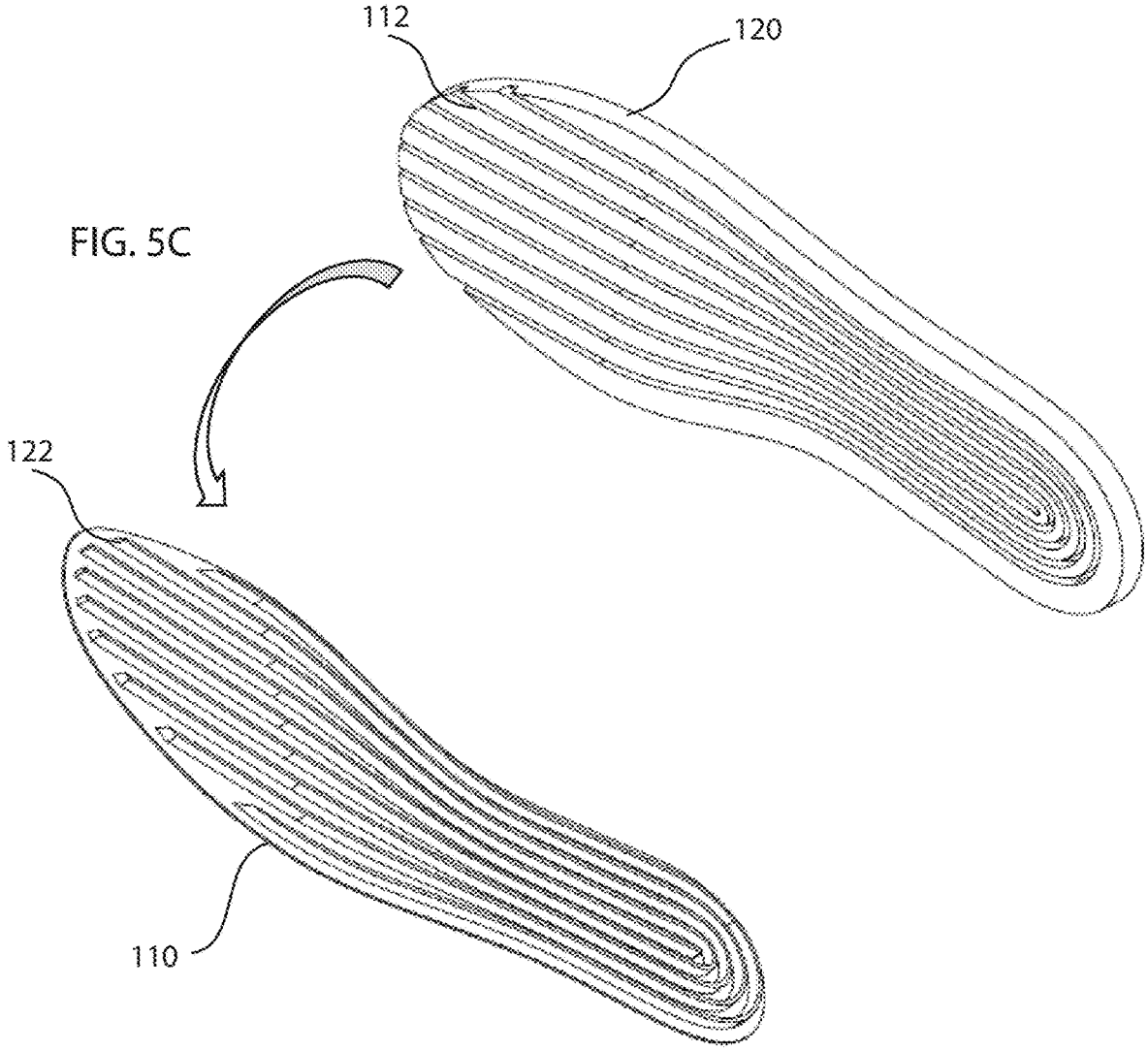
Figure 5D:
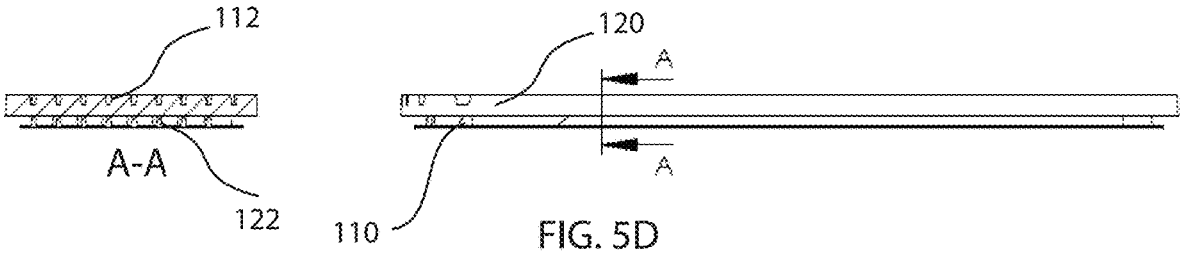
Figure 5E:
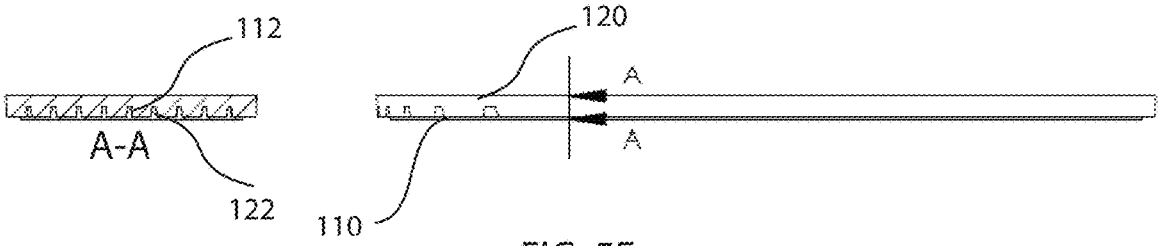

For example, and with reference to FIGS. 5A-5E, a plurality of protrusions on a sole portion 110 can comprise a series of positive concentric curves 122 extending from a first end, curving approximately 180 degrees at a second end, and returning to the first end (e.g., as in FIG. 5B). Similarly, a plurality of recesses on a footbed 120 can comprise a series of negative concentric curves 112 extending from a first end, curving approximately 180 degrees at a second end, and returning to the first end (e.g., as in FIG. 5A).

In a first size orientation (e.g., as in FIG. 5D), the footbed 120 negative concentric curves 112 are not adjacent to (so cannot be received into) the sole portion 110 positive concentric curves 122. The footbed can be rotated or flipped over 180 degrees. Alternatively, a first footbed can be switched with a second footbed (e.g., multiple footbeds included in a kit, or right and left footbeds of a pair of shoes). Thus, in a second size orientation (e.g., as in FIG. 5E), the footbed 120 negative concentric curves 112 are adjacent to and received into the sole portion 110 positive concentric curves 122.

In this regard, in example embodiments, when a plurality of protrusions 122 are adjacent to and received into a plurality of recesses 112 (e.g., as in FIG. 5C), relative movement between a footbed 120 and a sole portion 110 can be restricted to a single direction or to no direction.

In example embodiments, a plurality of protrusions and a plurality of recesses interlock with each other. For example, an end of a protrusion may comprise an expanded portion configured to pass a narrowed portion of a recess.

It will be apparent to those skilled in the art that various modifications and variations can be made in the present disclosure without departing from the spirit or scope of the disclosure. Thus, it is intended that the embodiments described herein cover the modifications and variations of this disclosure provided they come within the scope of the appended claims and their equivalents.

Numerous characteristics and advantages have been set forth in the preceding description, including various alternatives together with details of the structure and function of the devices and/or methods. The disclosure is intended as illustrative only and as such is not intended to be exhaustive. It will be evident to those skilled in the art that various modifications can be made, especially in matters of structure, materials, elements, components, shape, size and arrangement of parts including combinations within the principles of the invention, to the full extent indicated by the broad, general meaning of the terms in which the appended claims are expressed. To the extent that these various modifications do not depart from the spirit and scope of the appended claims, they are intended to be encompassed therein.

We claim:

1. A system for adjusting a dimension of a pair of shoes comprising:

a first shoe of the pair of shoes comprising a first footbed having a first plurality of recesses;

a second shoe of the pair of shoes comprising a second footbed having a second plurality of recesses;

a first sole portion having a first plurality of longer protrusions on a side of the first sole portion and a first plurality of shorter protrusions on an opposite side of the first sole portion; and a second sole portion having a second plurality of longer protrusions on a side of the second sole portion and a second plurality of shorter protrusions on an opposite side of the second sole portion;

wherein, in a first size orientation, the first sole portion is positioned in the first shoe such that the first plurality of shorter protrusions are adjacent to the first footbed and received into the first plurality of recesses, and the second sole portion is positioned in the second shoe such that the second plurality of shorter protrusions are adjacent to the second footbed and received into the second plurality of recesses;

wherein, in a second size orientation, the first sole portion is rotated and positioned in the second shoe such that the first plurality of longer protrusions are adjacent to the second footbed and received into the second plurality of recesses, and the second sole portion is rotated and positioned in the first shoe such that the second plurality of longer protrusions are adjacent to the first footbed and received into the first plurality of recesses; and wherein, a dimension is larger in the second size orientation than in the first size orientation.

2. The system of claim 1, wherein the dimension is inner girth, width, length and/or inner volume.

3. The system of claim 2, wherein the dimension corresponds to the length of a protrusion of the first plurality of longer protrusions or the depth of a recess of the first plurality of recesses.

4. The system of claim 1, wherein the first sole portion is a secondary insert adjacent to the strobel.

5. The system of claim 1, wherein the first plurality of longer protrusions and the first plurality of recesses permit imperfect alignment.

6. The system of claim 1, wherein the first plurality of longer protrusions and the first plurality of recesses are not uniform.

7. The system of claim 1, wherein, when the first plurality of longer protrusions are adjacent to and received into the second plurality of recesses, relative movement between the first sole portion and the second footbed is restricted to a single direction.

8. The system of claim 1, wherein the first plurality of longer protrusions and the first plurality of recesses interlock with each other.

9. The system of claim 1, wherein the first plurality of recesses are exclusively located on a forefoot portion of the first footbed and wherein the first plurality of longer protrusions are exclusively located on a forefoot portion of the first sole portion.

* * * * *